United States Patent [19]

Jochum et al.

[11] 4,066,199

[45] Jan. 3, 1978

[54] EXPLOSIVE CHARGE FEED ARRANGEMENT FOR A SETTING GUN

[75] Inventors: Peter Jochum, Meiningen, Austria; Hans Dieter Seghezzi, Vaduz, Liechtenstein

[73] Assignee: Hilti Aktiengesellschaft, Schaan, Liechtenstein

[21] Appl. No.: 669,491

[22] Filed: Mar. 23, 1976

[30] Foreign Application Priority Data

Apr. 1, 1975 Germany ..... 2514239

[51] Int. Cl.[2] ..... B25C 1/14

[52] U.S. Cl. ..... 227/10

[58] Field of Search ..... 227/8, 10, 11

[56] References Cited

U.S. PATENT DOCUMENTS

| | | | |
|---|---|---|---|
| Re. 27,628 | 5/1973 | Newton et al. | 227/10 |
| 3,330,108 | 7/1967 | Kvaule et al. | 227/11 |
| 3,540,141 | 11/1970 | Butler | 227/10 |
| 3,659,768 | 5/1972 | Brurelle | 227/10 |

*Primary Examiner*—Granville Y. Custer, Jr.
*Attorney, Agent, or Firm*—Toren, McGeady and Stanger

[57] ABSTRACT

In an explosive charge setting gun used for driving fastening elements into a hard target material, caseless charges are positioned in a magazine duct and are separated by spacers. A movable element in the gun picks up a caseless charge from the magazine and moves it into position to be fired. The movable member includes an ejector which displaces the spacer following the charge, from the magazine. The movable element can be a slidable barrel or a separate slide member. The ejector can be formed as recesses or cams on the movable element. The spacers are shaped so that they are not picked up by the movable element when a charge is moved into the firing position.

17 Claims, 11 Drawing Figures

EXPLOSIVE CHARGE FEED ARRANGEMENT FOR A SETTING GUN

SUMMARY OF THE INVENTION

The present invention concerns an explosive charge driven setting gun for driving fastening elements, such as bolts, nails and the like, into a hard target or receiving material, such as steel or concrete. The setting gun includes an axially displaceable barrel, a firing mechanism, a magazine duct for holding caseless charges to be used in firing the gun, with a receiving member formed in a displaceable part of the gun for moving a charge from the magazine duct into position for ignition by the firing mechanism.

There are known setting guns which operate in a single shot fashion. In such guns each charge is introduced manually into the firing chamber where it is ignited. However, this method of operation is very uneconomical and has the additional disadvantage that caseless charges can be damaged during introduction into the firing chamber or they may absorb moisture or crumble when improperly stored, for example, if they are placed in the pocket of the operator. To avoid such manual introduction, the charges are positioned in a magazine in the gun housing and are moved into the firing position by a movable slide member. Unfortunately, such a system involves considerable risks. If a charge positioned in the magazine is ignited, for example, by overheating of the slide member, the combustion can spread unhindered to adjacent charges in the magazine. Due to a high energy concentration, accidents may be caused which could lead to serious injury to the operator.

In another type of setting gun, it has been known to position the charges in a strip magazine and to ignite the charge within the magazine itself. This method has the disadvantage, however, that the magazine, generally formed of plastic, is damaged during the firing charge so that only a one-time use can be made of the magazine. This factor considerably increases the operating costs of such a setting gun.

Accordingly, the primary object of the present invention is to provide a setting gun which overcomes the problems previously experienced and combines safe operation with optimum economy.

Therefore, in accordance with the present invention, the caseless charges are arranged in a magazine duct separated by intermediate layers or spacers and the member which moves the charges into the firing position also includes elements for the ejection of the spacers located between the charges.

Due to the spacers, the charges are separated from one another within the magazine duct. The elements positioned in the slide member insure that a spacer is ejected as each charge is moved into the firing position and, at the same time, a new charge is located at the outlet from the magazine duct ready to be inserted into a receiving opening or recess in the slide member.

In one advantageous embodiment, the elements which displace the spacers are formed as grooves in the slide member for receiving one of the spacers. Such an arrangement of the entraining elements is particularly easy to produce from the manufacturing point of view. By specially configuring and dimensioning the grooves, it is possible to assure that only spacers are ejected and not caseless charges.

In another preferred arrangement, the entraining elements can be formed as cams. Such cams can also be used for additional control functions, like feeding the charges or stopping the slide member.

Preferably, the slide member may be a rotary member. Such a rotary member can have several receiving recesses or openings for the charges, so that the problem of overheating an individual receiving recess is eliminated. Furthermore, the rotary member can be provided with locking positions so that a new charge can be introduced into the rotary member as another charge is positioned for ignition, and any residues of an ignited charge can be removed as the rotary member moves through one complete cycle.

For a compact design of the gun it is advantageous if the rotary member moves in a plane substantially perpendicular to the main axis of the gun, that is, the axis of the gun barrel. By positioning the rotary member in this manner, the member can be operated by hand or by means of a mechanism arranged on the gun.

In still another advantageous arrangement, a spring biased lever can be positioned within the gun and attached to the slide member so that the slide member is moved in response to displacement of the barrel. The slide member performs a complete loading operation when the barrel is displaced outwardly from the gun housing and then pushed back into it. In guns which use a driving piston, the in and out movement of the barrel can be used for returning the driving piston into the firing position.

In a simple arrangement, the slide member is formed integrally with the barrel. As a result, no special mechanism is required to transmit the movement of the barrel to the slide member. This feature also serves to reduce to a considerable extent any susceptibility of the gun to operating difficulties.

In the event a charge has not been ignited or is incompletely ignited, it is advisable to provide an ejector displaceable through the receiving opening to remove any part of the charge which remains after ignition. Such an ejector can be arranged as a separate element in the slide member itself or it can be formed as a part of the barrel, in which case if the ejector fits the receiving opening exactly it can clear any combustion residues remaining in the opening.

For the rapid introduction of new charges into the magazine duct, it is advantageous if the charges and spacers are joined together in an alternating manner in a rod-shaped structure or arrangement. With such an arrangement the gun can be reloaded with a great savings in time. The individual charges and spacers can be held together by an adhesive or by a common sheath, for example, in the form of a so-called "shrunk-on foil". The risk that the relatively brittle charges might be damaged during loading is thus reduced. The separation of a charge from the magazine duct is effected by the slide member providing a slight shearing force for overcoming the force holding the charges and spacers together.

To prevent a spacer from entering into the receiving opening for the charge in the slide member, it is advisable if the spacer is shaped so that its passage into the opening is prevented. This effect can also be achieved, for example, if the charges and the spacers have the same but not a circular cross section by turning the spacers relative to the charges about the longitudinal axis of the magazine duct.

An advantageous embodiment of the charges and the spacers can be afforded by providing each with a different circumferential contour.

Considerable advantage is offered by an embodiment where the charges have a circular circumferential contour while the spacers have a corresponding square contour. For guiding the charges and the spacers through the magazine duct, it is advisable if the width or dimension across the square spacers corresponds to the diameter of the caseless charges. Further, from a manufacturing point of view it is easy to produce a square magazine duct.

To prevent any possibility of the charges being ejected by the elements which remove the spacers, it is advisable to provide a profiled surface on the spacers for matching engagement with the removing elements. Such a profiled surface could, for example, be provided by grooves extending parallel to the edges of the spacers. By providing a corresponding design of the elements on the slide member, it is possible to prevent ejection of the charges which do not have a similar profile or shaped configuration.

The various features of novelty which characterize the invention are pointed out with particularity in the claims annexed to and forming a part of this disclosure. For a better understanding of the inention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1A:
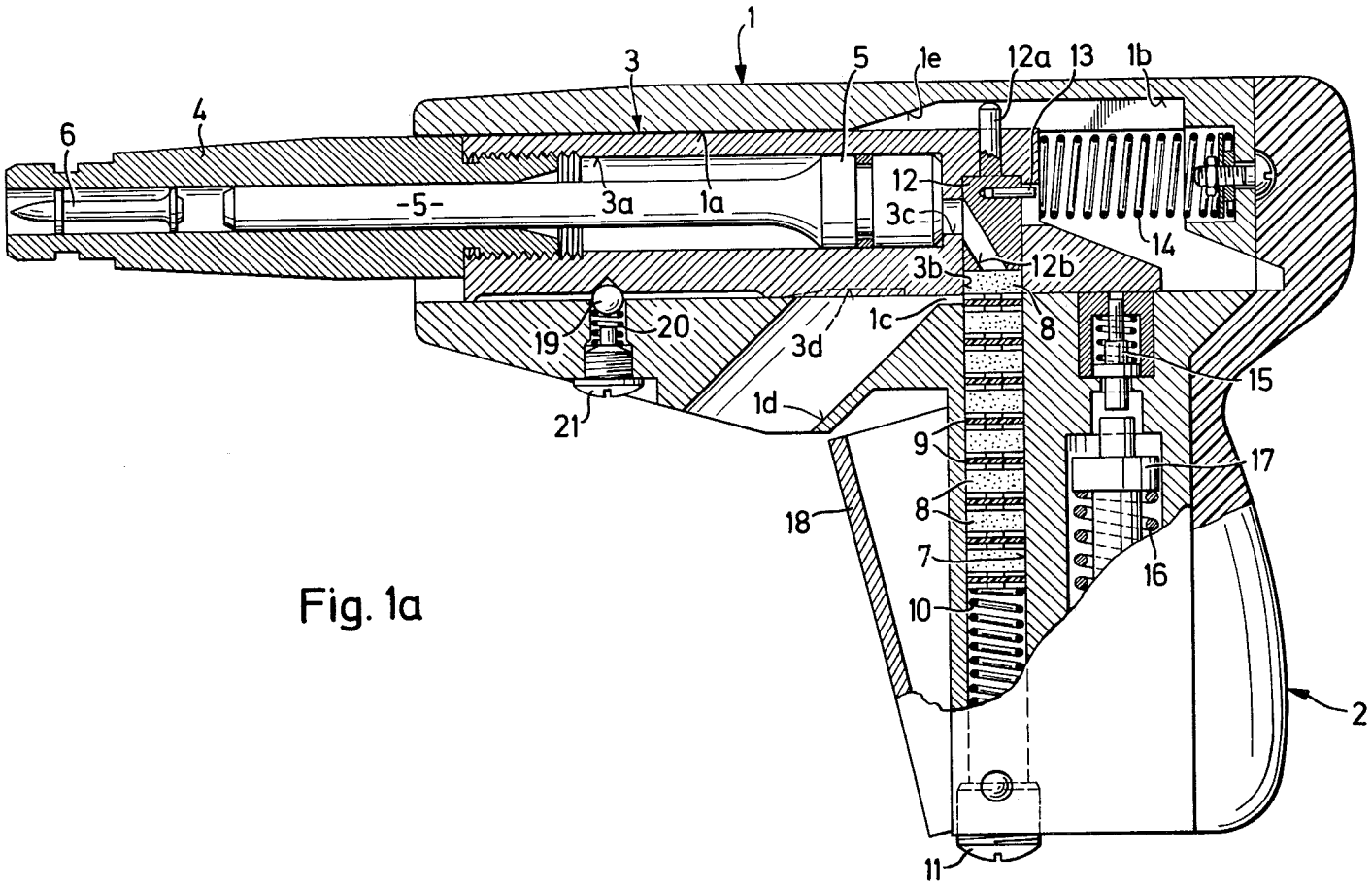
FIG. 1*a* is a side view, partly in section, of a setting gun embodying the present invention, with the gun illustrated in the charge feeding position.

In FIGS. 1*a*–1*c* and 2, one embodiment of a setting gun in accordance with the present invention is illustrated. The setting gun consists of a gun housing 1 with a handle 2 extending laterally outwardly from one end of the housing. An axially extending guide bore 1*a* is formed within the housing 1 and contains a barrel 3 which is axially displaceable within the bore. In threaded engagement with the forward end of the barrel 3 is a bolt guide 4 which projects outwardly from the forward end of the gun housing. An axially extending piston guide 3*a* is formed within the barrel 3 and a driving piston 5 is supported within the piston guide and extends forwardly into the bolt guide. The rearward end of the piston 5 has an enlarged head and the circumferential surface of the head is in surface contact with the piston guide 3*a.* A fastening element 6 is positioned in the forward portion of the bolt guide 4 ahead of the forward end of the piston 5.

Extending through the handle 2 from its lower end to the guide bore 1*a* is a magazine duct 7. Caseless charges 8 and spacers 9 are disposed in alternating arrangement within the magazine duct 7, that is, a spacer 9 is positioned between each of the charges 8. Preferably, the spacers 9 are formed of a non-flammable material or one that is difficult to burn. Below the stack of charges and spacers in the magazine duct is a feed spring 10 which biases the stack upwardly against the lower side of the barrel 3. At its lower end, the magazine duct is closed by a plug 11.

Adjacent its rearward end, an opening or bore 3*b* extends through the barrel 3 with the axis of the bore extending perpendicularly to the axis of the barrel. An ejector 12 is axially displaceably mounted within the bore 3*b.* The ejector 12 is secured against rotation by a pin 13. At its upper end, that is, the end more remote from the handle, the ejector has a pin-like projection 12*a* which protrudes from the barrel into a groove 1*b* in the gun housing, which groove extends in the axial direction of the barrel. The projection 12*a* has a smaller diameter than the ejector 12.

As shown in FIG. 1*a* the ejector 12 is spaced upwardly from the lower end of the bore 3*b* providing an opening or recess of sufficient size to receive a caseless charge 8 from the upper or outlet end of the magazine duct 7. Arranged between the rear end of the barrel 3 and the rearward end surface of the duct housing 1 is a pressure spring 14.

A firing mechanism is located within the handle 2 and consists of an axially displaceable firing pin 15, and a firing hammer 17 which is driven upwardly against the firing pin by the force of a firing spring 16. The firing mechanism is released by a trigger 18 mounted on the handle, since such trigger release mechanisms are well known a further description is not required. The position of the barrel shown in FIG. 1*a* is determined by the location of a ball notch within the lower surface of the barrel. A ball 19 mounted in a recess in the gun housing is biased upwardly by a spring 20 and a locking screw 21 closes the lower end of the opening in the housing. An axially extending groove is formed in the lower portion of the barrel and, as viewed in FIG. 1*a,* extends forwardly and rearwardly from the notch in the barrel. Accordingly, as can be seen in FIGS. 1*b* and 1*c* the ball 19 which rides within the groove in the bottom of the barrel limits the extent to which the barrel can be displaced forwardly and rearwardly in the gun housing.

Figure 1B:
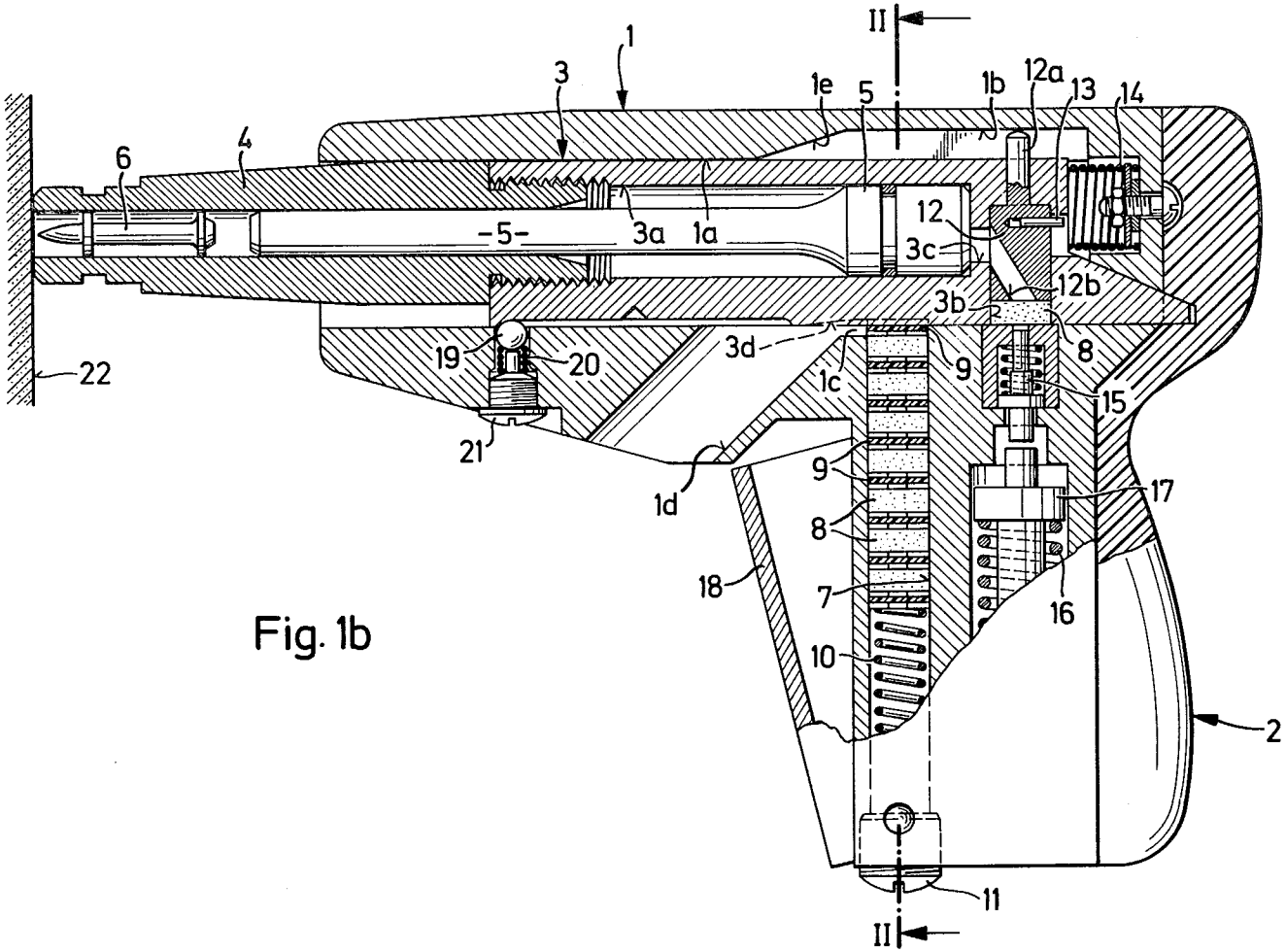
FIG. 1*b* is a view similar to FIG. 1*a* but with the gun in the firing position.

While FIG. 1*a* shows the barrel of the gun picking up a charge 8 from the magazine duct 7, in FIG. 1*b* the barrel has been moved rearwardly within the gun housing until the charge 8 within the lower end of the bore 3*b* is aligned above the firing pin 15. The rearward displacement of the barrel is obtained by pressing it against the target or receiving material 22, so that the barrel rides rearwardly within the guide bore 1*a* of the gun housing 1. As the barrel is pressed rearwardly, a sufficient force is required to overcome the pressure spring 14 and to place it in the compressed condition as shown in FIG. 1*b*. Further, as can be noted in the drawing, with the charge 8 in the bore 3*b* positioned above the firing mechanism, the ball 19 is located at the forward end of the groove in the lower side of the barrel so that further rearward movement of the barrel is prevented. When the firing hammer 17 drives the firing pin into the caseless charge 8, the gases generated by the ignition of the charge flow through a duct 12*b* in the ejector 12 and then pass through an opening 3*c* in the barrel which admits the gases against the rear end face of the driving piston. With the charge 8 moved rearwardly from the magazine duct 7, the spacer 9 immediately following the charge is biased upwardly toward the lower surface of the barrel by the feed spring 10 and forces the spacer into the ejector grooves 3*d*, shown in dotted lines, of the barrel. Note also FIG. 2 which shows the grooves 3*d*. The handle immediately forwardly of the magazine duct and adjacent the lower side of the barrel is spaced from the barrel providing a gap 1*c* which extends between the magazine duct and an ejection opening 1*d* which extends downwardly through the gun housing. The depth of the grooves 3*d* in combination with the depth of the gap 1*c* located between the housing 1 and the barrel 3 is equal to the thickness of a spacer 9. Accordingly, when the barrel is moved forwardly from the position shown in FIG. 1*b* toward that shown in FIG. 1*c*, the uppermost spacer 9 in the magazine duct is gripped by the grooves 3*d*, is moved forwardly through the gap 1*c* and then is ejected through the ejection opening 1*d* in the lower side of the gun housing 1.

Figure 1C:
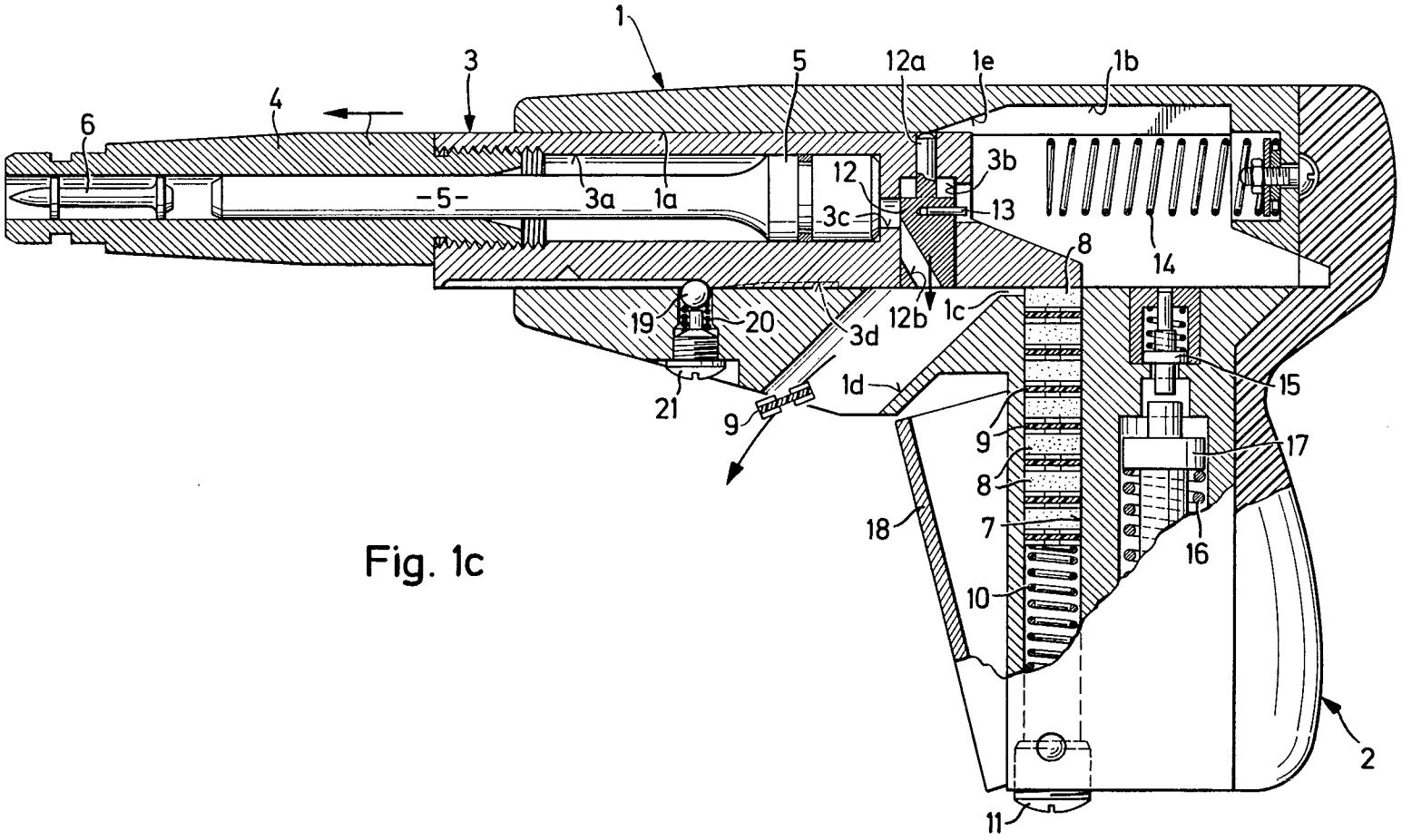
FIG. 1*c* is a view also similar to FIG. 1*a* but with the gun illustrated in the ejecting position.

As can be seen in FIGS. 1*a*–1*c* the forward end of the groove 1*b* has a downwardly inclined cam surface 1*e*. In the positions shown in FIGS. 1*a* and 1*b*, the projection 12*a* contacts the base of the groove 1*b* and the ejector 12 remains in its illustrated position. However, when the barrel is moved forwardly into the position illustrated in FIG. 1*c* the projection 12*a* comes in contact with the cam surface 1*e* and is depressed downwardly moving the ejector 12 downwardly causing the displacement of any residues of an incompletely burnt charge which remains in the lower end of receiving opening or recess of the bore 3*b*. The ball 19 seated within the groove in the lower end of the barrel 3 limits the forward movement of the barrel. Though not shown in the drawing, the combustion gases admitted against the rearward end face of the piston 5, displace the piston through the barrel and drive the fastening element 6 into the target material 22.

After a fastening element has been driven, another fastening element can be inserted into the front end of the barrel with the piston 5 being returned to its starting position relative to the barrel, note FIG. 1*c*. While the forward movement of the barrel to the position shown in FIG. 1*c* has caused the ejector 12 to move downwardly, the return of the barrel to the position shown in FIG. 1*a* with the ball 19 within the notch in the barrel aligns the bore 3*b* above the magazine duct 7 and the spring 10 presses a single charge 8 into the lower end of the bore so that the ejector 12 is displaced upwardly with the upper end of its projection 12*a* contacting the surface of the groove 1*b*.

Figure 2:
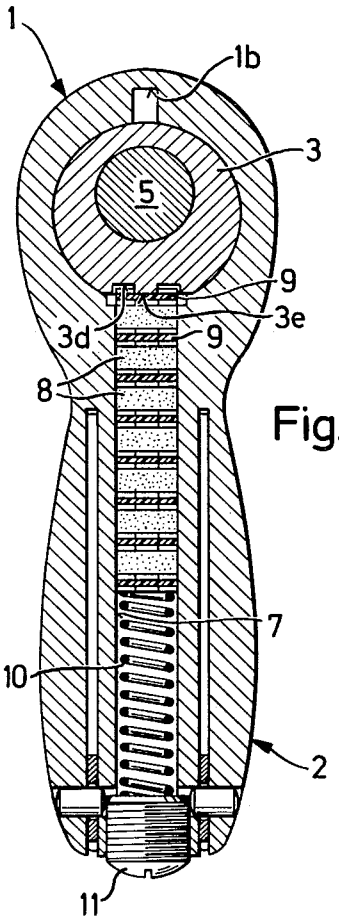
FIG. 2 is a cross sectional view of the setting gun taken along the line II—II in FIG. 1*b;*

FIG. 2 illustrates a section through the setting gun shown along the line II—II in FIG. 1*b*. In FIG. 2, the handle 2 is shown extending downwardly from the rearward portion of the housing 1. The magazine duct 7 is shown extending upwardly through the handle with its upper end opening to guide bore 1*a* within which the barrel is mounted. Within the magazine duct 7 the caseless charges 8 and the spacers 9 are in an alternating arrangement. A flat surface 3*e* is provided on the lower side of the barrel 3 facing toward the magazine duct 7. The grooves 3*d* are formed in the flat surface 3*e* and the upper portions of the spacer 9 fit into the ejector grooves 3*d*. Further, the groove 1*b* in the gun housing above the barrel 3 can be seen, it is within this groove that the projection 12*a* of the ejector 12 seats.

Figure 3:
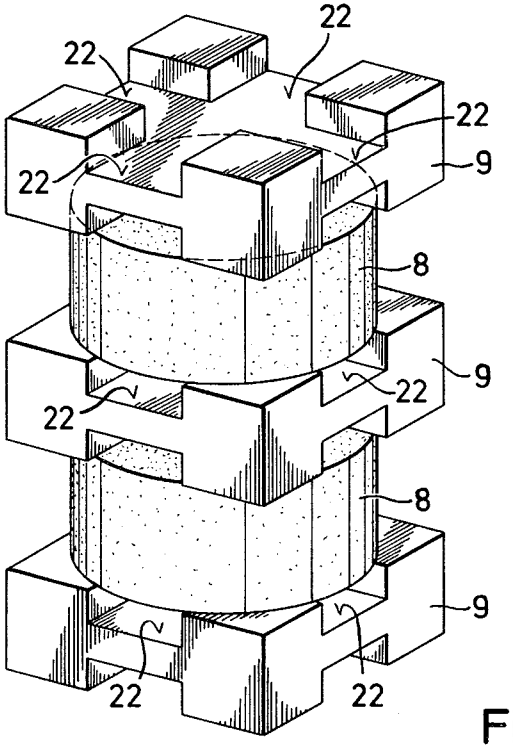
FIG. 3 is a perspective view of a number of caseless charges and spacers arranged for insertion into a magazine in the setting gun.

In FIG. 3, a rod-shaped arrangement of caseless charges 8 and spacers 9 is illustrated. The charges and spacers are joined to one another by an adhesive or, alternatively, a shrunk-on sheath can be formed over them to provide a unit insertable into the magazine duct. As can be seen in FIG. 3, the circumferential shape of the spacers 9 is square while that of the charges 8 is round or circular. The dimension of a side of the spacers is equal to the diameter of the circular charges. As a result, the four corners of the spacers project outwardly beyond the circumferential periphery of the charges. The upper and lower surfaces of the spacers are provided with grooves 22 which extend parallel to the sides of the spacers and intersect in the center forming a cross-shaped arrangement of the grooves. The depth of the grooves on each side is about one-third of the thickness of the spacers so that about one-third of the spacer thickness remains between the grooves on each of its opposite upper and lower faces. In operation, a charge can be separated from the remaining rod-shaped arrangement within the magazine duct by a slight shearing force for overcoming the force of the adhesive or other means which holds the charges and spacers together.

After a charge has been ignited and the barrel is moved forwardly, the upwardly extending lands on the upper surface of the spacer at the outlet opening from the magazine duct fit into the grooves 3*d* in the barrel so that forward movement of the barrel causes the spacer to be removed from the magazine duct permitting the next charge to position itself at the outlet opening from the duct ready to be inserted into the lower end of the bore 3*b*.

Figure 4:
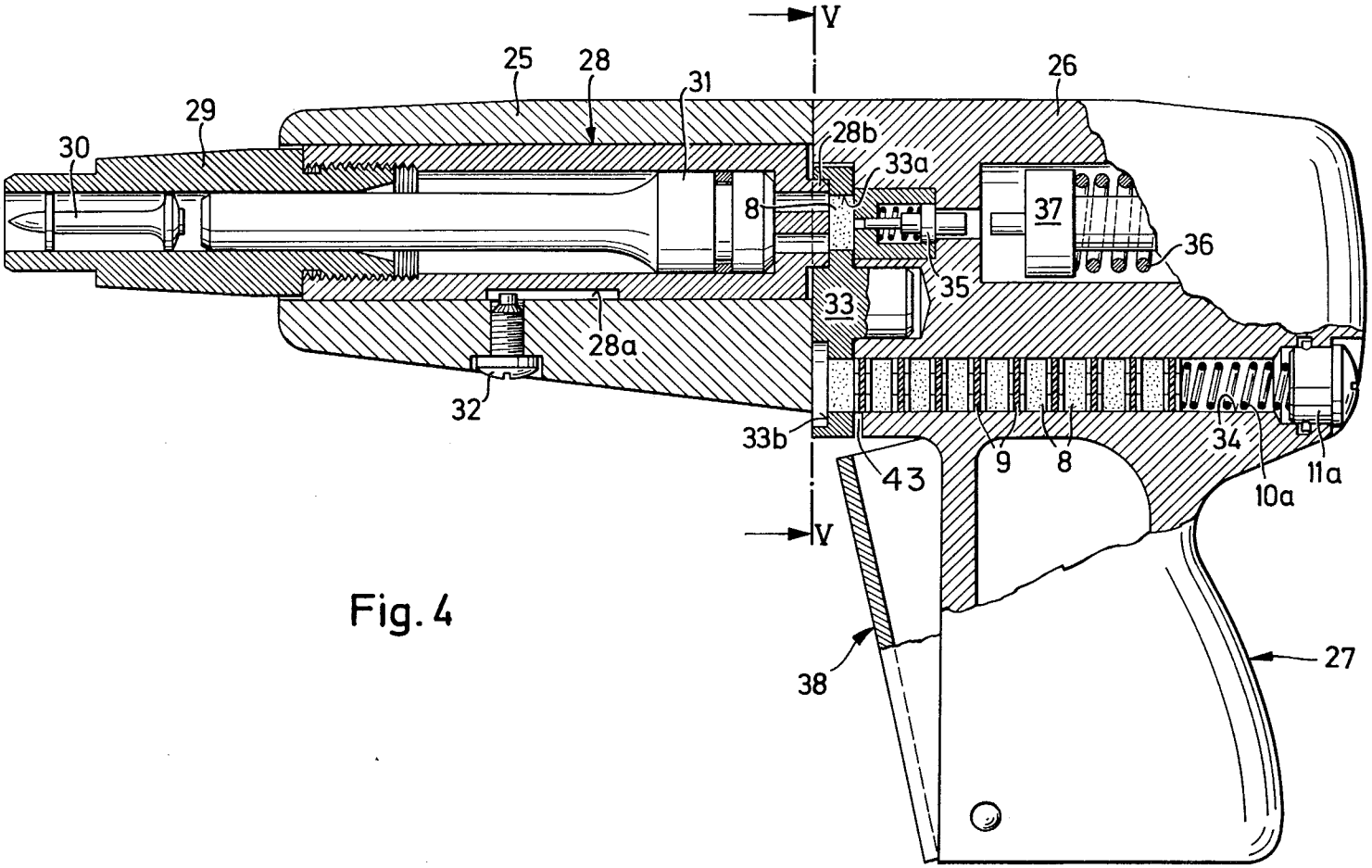
FIG. 4 is a side view, partly in section, of a setting gun illustrating another embodiment of the invention and the section is taken along the line IV—IV in FIG. 5.

In FIG. 4 another embodiment of the invention is shown in a setting gun which consists of a front housing part 25 and a rear housing part 26 with a handle 27 extending laterally downwardly from the rear housing part. Axially displaceably mounted in the front housing part is a barrel 28. A bolt guide 29 is in threaded engagement with the forward end of the barrel and extends forwardly from the front housing part 25. A fastening element or bolt 30 is positioned within the forward end portion of the bolt guide 29. An axially elongated piston 31 has its rearward end located within the barrel 28 and has its forward end located in bolt guide 29. The rearward end of the piston has an enlarged head which fits in sliding contact with the inner surface of the barrel 28 while the narrower shank portion of the piston is disposed in sliding contact within the inner surface of the bolt guide 29. A stop screw 32 threaded into the lower portion of the front housing part 25 extends into an axially extending groove 28*a* in the lower side of the barrel and prevents rotation of the barrel within the gun housing. At the front end of the rear housing part 26 which abuts the rear end of the front housing part 25, a rotary member 33 is positioned. The rotary member 33 contains three recesses 33*a*, angularly spaced apart into which charges 8 can be seated. Each opening or recess 33*a* is provided with a countersunk part 33*b* on the forwardly facing side of the rotary member which corresponds in diameter to a cylindrical lug 28*b* formed on the rear end face of the barrel 28. A magazine duct 34 extends through the rear housing part 26 in parallel relation with the axis of the barrel. As in the magazine duct 33 in FIGS. 1*a*–1*c*, alternating caseless charges 8 and spacers 9 are provided in the duct 34. A feed spring 10*a* at the rearward end of the stack of charges and spacers presses them forwardly toward the rearwardly facing side of the rotary member 33. A bayonet lock pin 11*a* forms a closure for the rearward end of the magazine duct 34 and also provides an abutment for the feed spring 10*a*. Spaced above the magazine duct within the rear housing part 26 is a firing mechanism which includes a spring biased firing pin 35, a firing hammer 37 and a firing spring 36 for driving the firing hammer against the firing pin. The firing mechanism is actuated in a known manner by a trigger 38 mounted on the handle 26.

Figure 5:
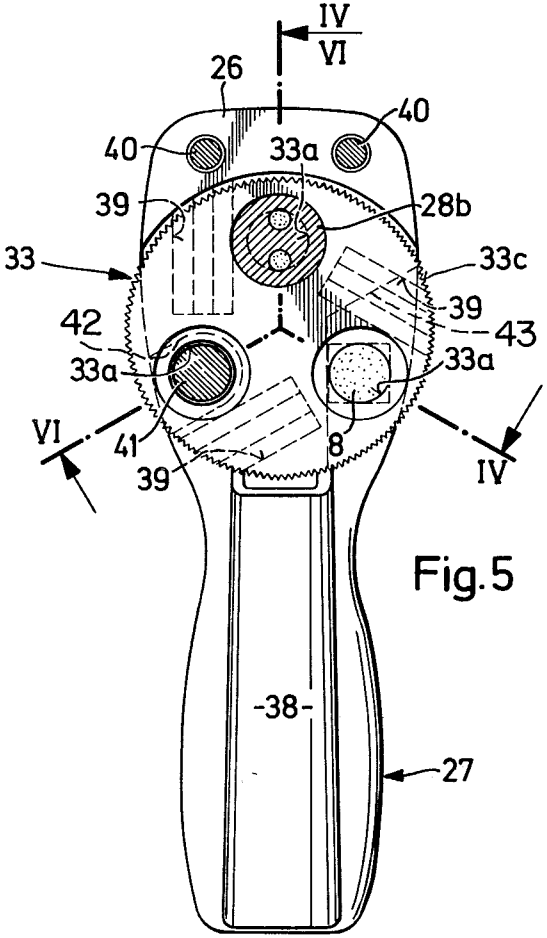
FIG. 5 is a sectional view of the setting gun taken along the line V—V in FIG. 4.

FIG. 5 illustrates a section taken along the line V—V in FIG. 4. The rotary member 33 has three recesses 33*a* into which caseless charges 8 can be inserted and it also has three locking positions. On its rearwardly facing side, the rotary member has an ejector groove 39 associated with each of the recesses 33*a* with the grooves extending tangentially to the recesses and opening to the circumferential edge of the rotary member. Spacers 9 are ejected through the grooves 39 after a caseless charge 8 has been inserted into a recess 33*a*. As can be seen in FIG. 4, a space or gap 43 is provided between the rearwardly facing side of the rotary member 33 and the adjacent surface of the rear housing part 26 for cooperation with the grooves 39 in ejecting the spacers. As viewed in FIG. 5, the rotary member 33 is rotatably mounted in the rear housing part 26 and moves counter-clockwise. The movement of the rotary member 33 can be effected manually by the knurling 33*c* formed on the circumferential edge of the rotary member. As shown in FIG. 5, the front housing part 25 is joined to the rear housing part 26 by screws or bolts 40.

Figure 6:
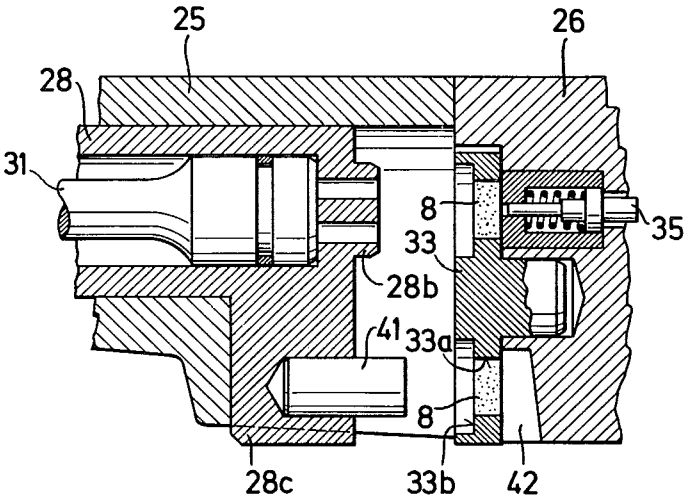
FIG. 6 is a partial sectional view taken along the line VI—VI in FIG. 5.

In FIG. 6 a partial sectional view is shown of the gun taken along the line VI—VI in FIG. 5. However, as distinguished from FIG. 4, the barrel 28 is shown displaced forwardly from the rear housing part 26. The barrel 28 has a web 28*c* extending laterally outwardly on the rear end of the barrel. An ejector 41 is secured in the web 28*a* and extends rearwardly from it. The ejector 41 is aligned with one of the positions of the recesses 33*a*, note FIG. 5, and serves to eject any charge which has not been ignited, into an ejection duct 42 located rearwardly of the rotary member 33. After the recess 33*a* is cleared by the ejector 41, it moves counter-clockwise into its next position where a charge 8 is inserted from the outlet opening of the magazine duct.

Figure 7A:
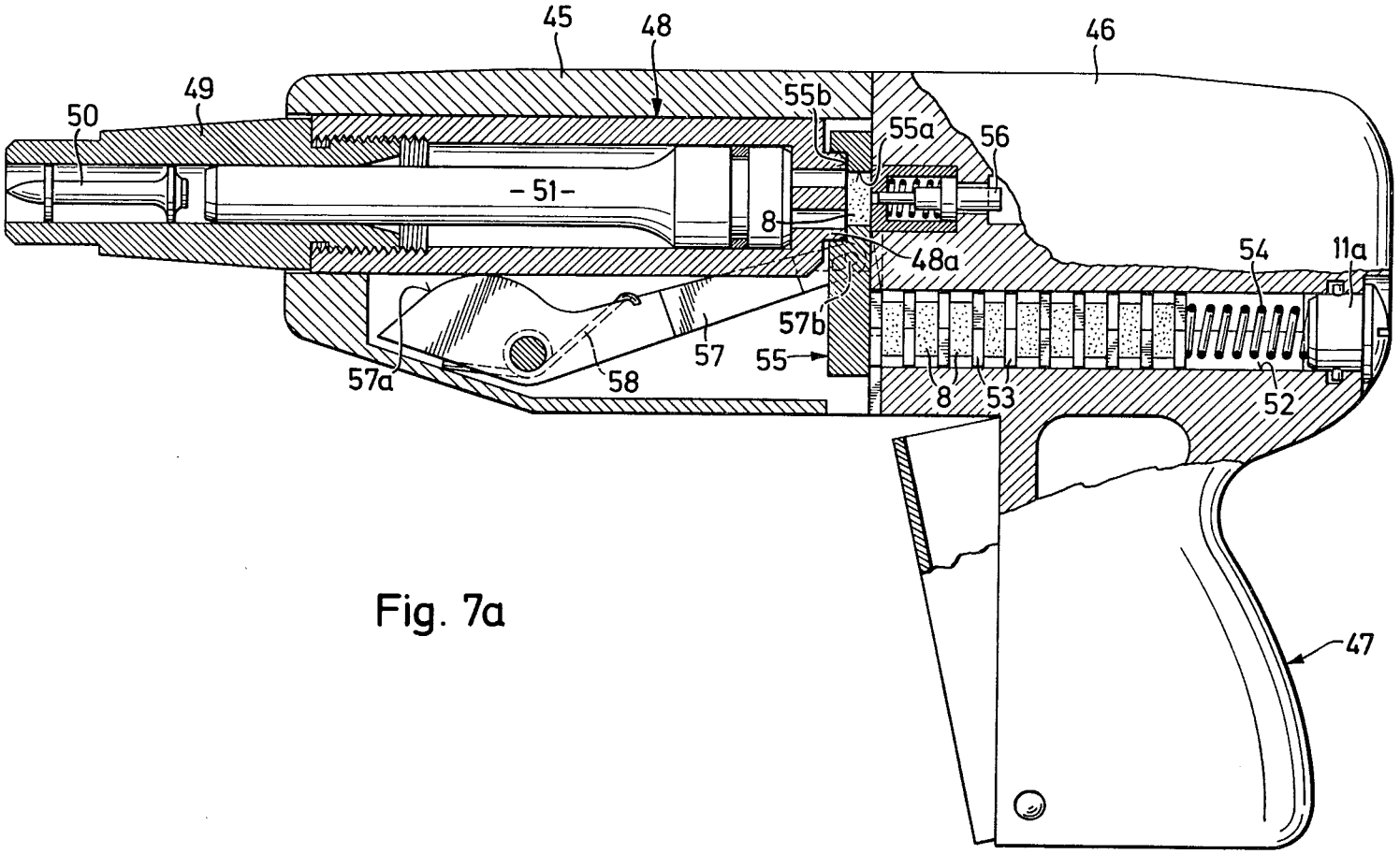
FIG. 7*a* is a side view, partly in section, illustrating still another embodiment of the present invention, with the gun shown in the firing position.
Figures 7B, 8:
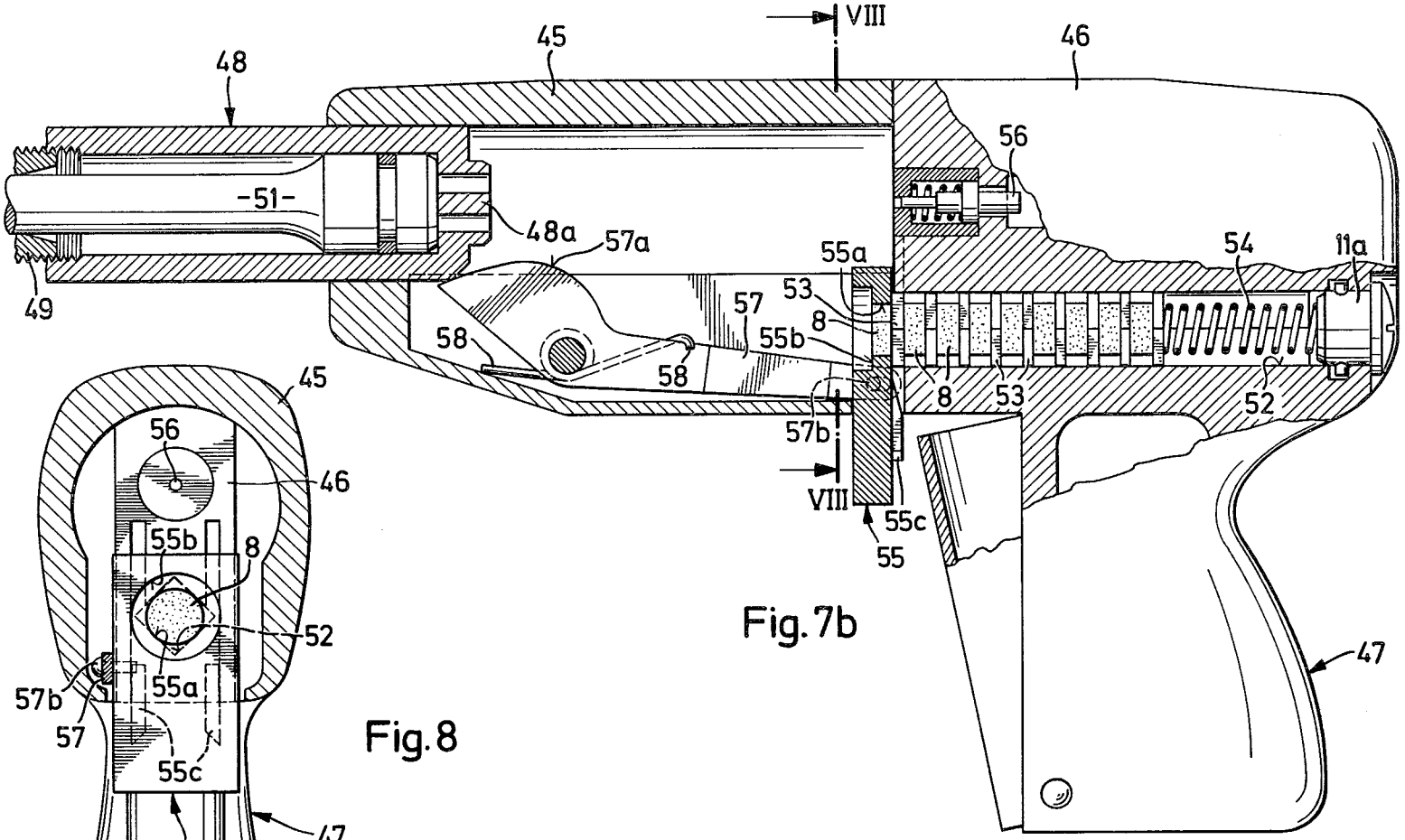
FIG. 7*b* is a view similar to FIG. 7*a,* however, illustrating the gun in the feeding position.
FIG. 8 is a sectional view taken along the line VIII—VIII in FIG. 7*b.*

In FIGS. 7*a*, 7*b* and 8 still another embodiment of a setting gun incorporating the invention is illustrated and the gun includes a front housing part 45 and a rear housing part 46 with a handle 47 extending downwardly from the rear housing part. A barrel 48 is axially displaceably mounted within the front housing part and a bolt guide 49 is threaded into the barrel and extends forwardly from it and outwardly from the front housing part. A fastening element or bolt 50 is shown within the bolt guide 49 ready to be inserted into a receiving material. Axially displaceably mounted within the barrel 48 and bolt guide 49 is a driving piston 51 such as shown in the other two embodiments. Arranged within the rear housing part is a magazine duct 52 extending in generally parallel relation with the axial direction of the barrel. Arranged within the magazine duct are a plurality of alternating charges 8 and spacers 53. The rearward end of the duct is closed by a bayonet lock pin 11*a* and a spring 54 is positioned between the lock pin and the stack of charges and spacers and biases the stack toward a slide member 55. The slide member 55 has a recess 55*a* into which a charge 8 can be inserted. As with the rotary member, the forward face of the slide member 55 has an annular shaped countersunk portion 55*b* concentric with the recess and shaped to correspond to the diametrical dimensions of a cylindrical lug 48*a* located on the rearward end of the barrel 48. A firing mechanism is located within the rear housing part and in this embodiment only a firing pin 56 of the mechanism is illustrated. The slide member serves to move charges 8 from the magazine duct 52 into aligned position with the rearward end of the barrel 48 and the firing pin 56. The slide member 55 is moved by the barrel 48 and the movement of the barrel is transmitted to the member via a two-arm lever 57 pivotally mounted in the front housing part 45 and having a cam surface 57*a*. The cam surface 57*a* is located on one end of the two-arm lever 57 while its other end is connected to the slide member 55 by means of a pin extending into an oblong slot in the slide member. A spring element 58 biases the cam surface 57*a* against the lower surface of the barrel.

In FIG. 7*b*, the slide member 55 is shown displaced from the position in FIG. 7*a* and in alignment with the magazine duct so that a charge 8 has been fed from the duct into the recess 55*a* within the slide member. In FIG. 7*b*, the barrel is shown extending forwardly from the front housing part. Because of the action of the spring 58, with the barrel 48 displaced forwardly the lever 57 moves in the clockwise direction and displaces the slide member 55 downwardly until its recess 55*a* aligns with the outlet opening from the magazine duct 52. The spring 54 presses the charge 8 in the outlet opening into the recess 55*a*. The feed from the duct is stopped by the action of the next spacer contacting the rearward face of the slide member. As pointed out above, by providing a different configuration to the circumferential surface of the spacer from that of the charge, it is possible to prevent the spacer from entering into the charge receiving recess. As the barrel is displaced rearwardly within the front housing part, its lower surface, riding over the cam surface 57*a* of the lever, causes the lever to move in the counter-clockwise direction with the recess 55*a* moving upwardly into alignment with and between the firing pin 56 and the rearward end of the barrel 48. The setting gun is again in the position shown in FIG. 7*a* and is ready to be fired. If a charge is not ignited, it is displaced forwardly from the recess 55*a* by the next charge when the lever 57 moves the slide member downwardly. Ejector cams 55*c* are formed on the rearward facing side of the slide member 55 and serve to eject the spacers 53 downwardly through the gap left between the rearwardly facing side of the slide member and the adjacent surface of the rear housing part.

In FIG. 8 a cross section through the setting gun is shown taken along the line VIII—VIII in FIG. 7*b*. In this view the slide member 55 has been displaced downwardly by the lever 57 into position to receive a charge 8 from the magazine duct 52, that is, the recess 55*a* in the slide member is located in front of the outlet opening from the magazine duct. Shown in dotted lines on the rearwardly facing side of the slide member is the ejecting cams 55*c* which displace the spacers 53 from the setting gun.

While specific embodiments of the invention have been shown and described in detail to illustrate the application of the inventive principles, it will be understood that the invention may be embodied otherwise without departing from such principles.

What is claimed is:

1. Explosive charge driven setting gun for driving fastening elements into a hard target material, comprising a gun housing including a handle, a firing mechanism within said housing, a magazine duct within said housing arranged to receive a plurality of alternating caseless charges and spacers and having an outlet opening spaced from said firing mechanism through which caseless charges can be removed from said magazine duct, means movably displaceable within said gun housing and including a receiving recess displaceable between a first position in alignment with the outlet opening from said magazine duct and a second position juxtaposed to said firing mechanism so that a caseless charge can be received from said magazine duct in the first position of said receiving recess and then moved to the second position for ignition by said firing mechanism, wherein the improvement comprises that said means include ejector means for displacing a spacer from the outlet opening from said magazine duct after the caseless charge immediately preceding the spacer has been displaced into said receiving recess from said first position, into a position for displacing said spacer out of said gun housing as said means moves from the second position to the first position.

2. Explosive charge driven setting gun, as set forth in claim 1, wherein said means comprises an axially elongated barrel axially displaceable within said gun housing, and said ejector means comprises a recess formed in said barrel adjacent said receiving recess to receive a spacer therein from said magazine duct as said receiving recess containing a caseless charge is moved into the second position so that upon return of said receiving recess into the first position the spacer in said ejector recess is displaced from the magazine duct for ejection from the gun housing.

3. Explosive charge driven setting gun, as set forth in claim 2, wherein said gun housing forms a bore having a front end and rearward end within which said barrel is axially displaceable, a displaceable ejector member mounted in said barrel in alignment with said receiving recess, a groove formed in the bore of said gun housing, said groove having a first surface in generally parallel relation to the axis of said barrel and a second surface extending from one end of said first surface and converging inwardly from said first surface toward the axis of said barrel, a projection secured to and extending outwardly from said ejection member and extending into said groove, said projection arranged to contact said groove when said barrel is displaced in the direction of the forward end of said gun housing so that said ejection member is displaced through said receiving recess.

4. Explosive charge driven setting gun, as set forth in claim 2, wherein said barrel has a groove extending in its axial direction with a groove notch formed inwardly from the groove intermediate the ends thereof, a spring biased ball mounted in said gun housing and engageable within said groove and said groove notch for limiting the axial movement of said barrel and for determining when said ball seats within said groove notch, the first position of said receiving means.

5. Explosive charge driven setting gun, as set forth in claim 1, wherein said means comprises a member rotatably mounted in said gun housing with said member having a plurality of angularly spaced said receiving recesses, and said ejector means comprises an ejecting groove associated with each of said angularly spaced receiving recesses for displacing the spacers from said magazine duct as said member is rotated.

6. Explosive charge driven setting gun, as set forth in claim 5, wherein said rotatable member is mounted for rotation about an axis disposed in substantially parallel relation with the axis of said barrel and said receiving recesses located in a face of said member with the face located in a plane extending perpendicular to the axis of said barrel.

7. Explosive charge driven setting gun, as set forth in claim 1, wherein said means comprises an axially elongated barrel axially displaceable within said gun housing, a spring biased lever pivotally secured in said gun housing, said lever having a cam surface formed thereon and disposed in contact with said barrel, a slide member secured to said lever at a position spaced from said cam surface and said slide member having said receiving recess therein so that as said barrel is displaced it moves over said cam surface and the spring biasing action pivots said lever which moves said receiving recess in said slide member from said second position to said first position, and said ejector means comprises cam means formed on said slide member for displacing a spacer from said magazine duct as said slide member moves from the second position to the first position.

8. Explosive charge driven setting gun, as set forth in claim 7, wherein said gun housing forms a bore having a forward end and a rearward end within which said barrel is axially displaceable, an ejector member mounted in said barrel and alignable with said receiving recess in said slide member, said ejector member comprising a projection extending from the rearward end of said barrel in generally parallel relation with the axis of said barrel and having a transverse cross section arranged to fit closely into and pass through said receiving recesses in said slide member, said projection arranged to fit into one of said receiving recesses when said barrel is moved in the direction of the rearward end of said gun housing.

9. Explosive charge driven setting gun, as set forth in claim 1, wherein a member is mounted in said means and is movably displaceable through said receiving recess for displacing unfired charges or imcompletely burnt charges from said recess.

10. Explosive charge driven setting gun, as set forth in claim 1, including a magazine insertable into said magazine duct, said magazine comprising a plurality of caseless charges and a plurality of spacers with said caseless charges and spacers secured together in an alternating manner and forming an axially extending rod-like member shaped to fit into said magazine duct.

11. Explosive charge driven setting gun, as set forth in claim 10, wherein said spacers are shaped to interfit with said ejector means.

12. Explosive charge driven setting gun, as set forth in claim 11, wherein said spacers have projections extending outwardly from at least one side thereof which side extends transversely of the axial direction of said rod-like member and said projections shaped to interfit with said ejector means.

13. Explosive charge driven setting gun, as set forth in claim 10, wherein said caseless charges have a circumferential shape extending around the axis of said rod-like member and said spacers have a circumferential shape extending around the axis of said rod-like member which shape of said spacers is different from the circumferential shape of said caseless charges.

14. Explosive charge driven setting gun, as set forth in claim 13, wherein said caseless charges have a circular circumferential shape and said spacers have a square circumferential shape.

15. Explosive charge driven setting gun, as set forth in claim 13, wherein said receiving recess has a circumferential shape conforming to the circumferential shape of said caseless charges and the maximum diametrical dimension of said spacers being greater than the diametrical dimension of said caseless charges so that said spacers are prevented from entering into said receiving recess.

16. Explosive charge driven setting gun, as set forth in claim 1, wherein said magazine duct extends through said gun housing with an opening in the surface of said gun housing to said duct, a plug member insertable into the opening to said duct for forming a closure therefor, and a spring positioned within said magazine duct and extending between said plug and said caseless charges and spacers for biasing said caseless charges and spacers toward the outlet opening from said magazine duct.

17. Explosive charge driven setting gun, as set forth in claim 1, wherein said gun housing adjacent the outlet opening from said magazine duct forming a gap, said gun housing also forming an ejection opening extending downwardly from below said barrel, said gap extending between the outlet opening from said magazine duct and said ejection opening for cooperating with said ejector means in displacing the spacers from said setting gun.

* * * * *